US010096404B2

(12) United States Patent
Brigandi et al.

(10) Patent No.: US 10,096,404 B2
(45) Date of Patent: Oct. 9, 2018

(54) PROCESS FOR DEGASSING CROSSLINKED POWER CABLES

(71) Applicant: Dow Global Technologies LLC, Midland, MI (US)

(72) Inventors: Paul J. Brigandi, Schwenksville, PA (US); Bharat I. Chaudhary, Princeton, NJ (US); Jeffrey C. Munro, Bellaire, TX (US); Gary R. Marchand, Gonzales, LA (US)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 263 days.

(21) Appl. No.: 15/021,008

(22) PCT Filed: Sep. 9, 2014

(86) PCT No.: PCT/US2014/054659

§ 371 (c)(1),
(2) Date: Mar. 10, 2016

(87) PCT Pub. No.: WO2015/041885

PCT Pub. Date: Mar. 26, 2015

(65) Prior Publication Data

US 2016/0225490 A1 Aug. 4, 2016

Related U.S. Application Data

(60) Provisional application No. 61/880,260, filed on Sep. 20, 2013.

(51) Int. Cl.

| | |
|---|---|
| ***H01B 13/00*** | (2006.01) |
| ***H01B 19/02*** | (2006.01) |
| ***H01B 3/44*** | (2006.01) |
| ***H01B 1/24*** | (2006.01) |
| ***H01B 9/00*** | (2006.01) |

(52) U.S. Cl.
CPC ..... *H01B 13/0016* (2013.01); *H01B 1/24* (2013.01); *H01B 3/441* (2013.01); *H01B 9/006* (2013.01); *H01B 19/02* (2013.01)

(58) Field of Classification Search
CPC ..... H01B 13/0016; H01B 9/006; H01B 1/24; H01B 3/441
See application file for complete search history.

(56) References Cited

U.S. PATENT DOCUMENTS

| | | | | |
|---|---|---|---|---|
| 4,454,306 | A * | 6/1984 | Fujii | C08F 297/08 525/313 |
| 4,857,600 | A | 8/1989 | Gross et al. | |
| 5,064,802 | A | 11/1991 | Stevens et al. | |
| 5,246,783 | A * | 9/1993 | Spenadel | H01B 3/441 174/110 R |
| 5,575,965 | A | 11/1996 | Caronia et al. | |
| 6,496,629 | B2 | 12/2002 | Ma et al. | |
| 6,714,707 | B2 | 3/2004 | Rossi et al. | |
| 7,355,089 | B2 | 4/2008 | Chang et al. | |
| 7,504,347 | B2 | 3/2009 | Poon et al. | |
| 7,514,517 | B2 | 4/2009 | Hoenig et al. | |
| 7,524,911 | B2 | 4/2009 | Karjala et al. | |
| 7,579,408 | B2 | 8/2009 | Walton et al. | |
| 7,582,716 | B2 | 9/2009 | Liang et al. | |
| 7,608,668 | B2 * | 10/2009 | Li Pi Shan | C08F 212/08 525/191 |
| 2003/0055179 | A1 * | 3/2003 | Ota | B32B 27/32 525/242 |
| 2003/0075707 | A1 * | 4/2003 | Easter | C08L 23/06 252/511 |
| 2006/0199887 | A1 | 9/2006 | Liang et al. | |
| 2008/0254289 | A1 | 10/2008 | Bostrom et al. | |
| 2010/0181095 | A1 | 7/2010 | Smedberg et al. | |
| 2010/0181096 | A1 | 7/2010 | Smedberg et al. | |
| 2010/0193217 | A1 | 8/2010 | Laurenson et al. | |
| 2013/0082215 | A1 | 4/2013 | Esseghir et al. | |

FOREIGN PATENT DOCUMENTS

| | | | |
|---|---|---|---|
| CN | 101376732 | A | 3/2009 |
| CN | 102426885 | A | 4/2012 |
| WO | 93/19104 | A1 | 9/1993 |

(Continued)

OTHER PUBLICATIONS

Dobrynin, J. Chem Phys., 107(21), Dec. 1, 1998, pp. 9234-9238.

(Continued)

*Primary Examiner* — Nathaniel Herzfeld

(74) *Attorney, Agent, or Firm* — Husch Blackwell LLP

(57) ABSTRACT

A power cable comprising: (A) a conductor, (B) an insulation layer, and (C) a semiconductor layer comprising in weight percent based on the weight of the semiconductor layer: (1) 49-98% of a crosslinked olefin block copolymer (OBC) having a density less than (<) 0.9 grams per cubic centimeter (g/cm$^3$), a melt index greater than (>) 1, and comprising in weight percent based on the weight of the OBC: (a) 35-80% soft segment that comprises 5-50 mole percent (mol %) of units derived from a monomer comprising 3 to 30 carbon atoms; and (b) 20-65% hard segment that comprises 0.2-3.5 mol % of units derived from a monomer comprising 3 to 30 carbon atoms; (2) 2-51% conductive filler, the insulation layer and semiconductor layer in contact with one another, is degassed by a process comprising the step of exposing the cable to a temperature of at least 80° C. for a period of time of at least 24 hours.

10 Claims, No Drawings

(56) References Cited

FOREIGN PATENT DOCUMENTS

| | | | | | |
|---|---|---|---|---|---|
| WO | 95/00526 | A1 | | 1/1995 | |
| WO | 95/14024 | A1 | | 5/1995 | |
| WO | 98/49212 | A1 | | 11/1998 | |
| WO | 2005/090427 | A2 | | 9/2005 | |
| WO | WO 2011037747 | A2 | * | 3/2011 | ..... C08L 23/0815 |
| WO | WO 2011159447 | A1 | * | 12/2011 | ..... C08F 297/083 |

OTHER PUBLICATIONS

Potemkin et al., Physical Review E, vol. 57, No. 6, Jun. 1998, pp. 6902-6912.

T. Andrews et al., IEEE Electrical Insulation Magazine, vol. 22, No. 6, Nov./Dec. 2006, pp. 5-16.

* cited by examiner

PROCESS FOR DEGASSING CROSSLINKED POWER CABLES

FIELD OF THE INVENTION

This invention relates to power cables. In one aspect, the invention relates to crosslinked power cables while in another aspect, the invention relates to the degassing of crosslinked power cables.

BACKGROUND OF THE INVENTION

All peroxide cured power cables retain some of the decomposition by-products within their structure which can affect cable performance. Therefore, these by-products must be removed by a process known as degassing. Elevating the treatment temperature can reduce the degassing times. Temperatures range between 50° C. and 80° C., more preferably between 60° C. and 70° C. However, when degassing at these elevated temperatures, it is of utmost importance to take caution not to damage the cable core. The thermal expansion and softening of the materials from which the cable is constructed is known to damage the core causing "flats" and deforming the outer semiconductive shield layer. The latter is made of flexible compounds comprising conductive fillers to impart electrical conductivity for cable shielding. This damage can lead to failures during routine testing and thus the temperature needs to be decreased as the cable weight increases. The present invention uses a higher melting point olefin block copolymer for the semiconductive layer(s) to increase the deformation resistance at elevated temperatures, which in turn enables higher temperature degassing.

SUMMARY OF THE INVENTION

The compositions used in the practice of this invention can be crosslinked with peroxides to yield the desired combination of properties for the manufacture of power cables, particularly high voltage power cables, with an improved degassing process and their subsequent use in the applications, i.e., acceptably high deformation resistance (for higher temperature degassing), acceptably low volume resistivity of the semiconductive compositions, acceptably high scorch-resistance at extrusion conditions, acceptably high degree of crosslinking after extrusion, and acceptable dissipation factor of crosslinked polyethylene (XLPE) insulation after being in contact with the semiconductive shield (no negative impact of catalyst components from olefin block copolymers).

In one embodiment the invention is a process of degassing a power cable, the cable comprising:

(A) a conductor, (B) an insulation layer, and (C) a semiconductor layer comprising in weight percent based on the weight of the semiconductor layer:

(1) 49-98% of a crosslinked olefin block copolymer (OBC) having a density less than (<) 0.9 grams per cubic centimeter (g/cm$^3$), a melt flow rate (MFR) greater than (>) 1, and comprising in weight percent based on the weight of the OBC:

(a) 35-80% soft segment that comprises 5-50 mole percent (mol %) of units derived from a monomer comprising 3 to 30 carbon atoms; and (b) 20-65% hard segment that comprises 0.2-3.5 mol % of units derived from a monomer comprising 3 to 30 carbon atoms;

(2) 2-51% conductive filler;

the insulation layer and semiconductor layer in contact with one another, the process comprising the step of exposing the cable to a temperature of at least 80° C., or 90° C., or 100° C., or 110° C., or 120° C., or 130° C. for a period of time of at least 24 hours.

In one embodiment the power cable is a medium, high or extra-high voltage cable. In one embodiment the OBC is crosslinked using a peroxide crosslinking agent.

DETAILED DESCRIPTION OF THE PREFERRED EMBODIMENT

Definitions

For purposes of U.S. patent practice, all patents, patent applications and other cited documents within this application are incorporated in their entirety herein by reference to the extent that they are not in conflict with the disclosure of this application.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, the amount of a particular component in a composition.

"Comprising", "including", "having" and like terms mean that the composition, process, etc. is not limited to the components, steps, etc. disclosed, but rather can include other, undisclosed components, steps, etc. In contrast, the term "consisting essentially of" excludes from the scope of any composition, process, etc. any other component, step etc. excepting those that are not essential to the performance, operability or the like of the composition, process, etc. The term "consisting of" excludes from a composition, process, etc., any component, step, etc. not specifically disclosed. The term "or", unless stated otherwise, refers to the disclosed members individually as well as in any combination.

"Wire" and like terms mean a single strand of conductive metal, e.g., copper or aluminum, or a single strand of optical fiber.

"Cable" and like terms mean at least one wire or optical fiber within a sheath, e.g., an insulation covering or a protective outer jacket. Typically, a cable is two or more wires or optical fibers bound together, typically in a common insulation covering and/or protective jacket. The individual wires or fibers inside the sheath may be bare, covered or insulated. Combination cables may contain both electrical wires and optical fibers. The cable, etc. can be designed for low, medium, high and extra high voltage applications. Low voltage cables are designed to carry less than 3 kilovolts (kV) of electricity, medium voltage cables 3 to 69 kV, high voltage cables 70 to 220 kV, and extra high voltage cables excess of 220 kV. Typical cable designs are illustrated in U.S. Pat. Nos. 5,246,783, 6,496,629 and 6,714,707.

"Conductor", "electrical conductor" and like terms mean an object which permits the flow of electrical charges in one or more directions. For example, a wire is an electrical conductor that can carry electricity along its length. Wire conductors typically comprise copper or aluminum.

Semiconductor Layer

In one embodiment the semiconductor layer comprises in weight percent based on the weight of the semiconductor layer:

(1) 49-98%, typically 55-95% and more typically 60-90%, of a crosslinked olefin block copolymer (OBC) having a density less than (<) 0.91 grams per cubic centimeter (g/cm$^3$), typically <0.9 g/cm$^3$ and more typically <0.896 g/cm$^3$, and a MFR greater than (>) 1 g/10 min, typically >2 g/10 min and more typically >5 g/10 min, and comprising in weight percent based on the weight of the OBC:
   (a) 35-80%, typically 40-78% and more typically 45-75% soft segment that comprises 5-50 mole percent (mol %), typically 7-35 mol % and more typically 9-30 mol %, of units derived from a monomer comprising 3 to 30 carbon atoms, typically 3 to 20 carbon atoms and more typically 3 to 10 carbon atoms; and
   (b) 20-65%, typically 22-60% and more typically 24-55%, hard segment that comprises 0.2-3.5 mol %, typically 0.2-2.5 mol % and more typically 0.3-1.8 mol %, of units derived from a monomer comprising 3 to 30, typically 3 to 20 and more typically 3 to 10, carbon atoms; and
(2) 2-51%, typically 5-45% and more typically 10-40%, conductive filler;

with the insulation layer and semiconductor layer in contact with one another.

In one embodiment the density of the OBC is greater than (>) 0.91 g/cm$^3$, typically >0.92 g/cm$^3$ and more typically >0.93 g/cm$^3$. In one embodiment the MFR of the OBC is less than (<) 1 g/10 min, typically <0.5 g/10 min and more typically <0.2 g/10 min. Density is measured according to ASTM D792). Melt flow rate (MFR) or melt index ($I_2$) is measured using ASTM D-1238 (190° C./2.16 kg).

Although the cable can comprise more than one semiconductive layer and more than one insulation layer, at least one semiconductive layer is in contact with at least one insulation layer. The cable comprises one or more high potential conductors in a cable core surrounded by several layers of polymeric materials. In one embodiment the conductor or conductor core is surrounded by and in contact with a first semiconductive shield layer (conductor or strand shield) which in turn is surrounded by and in contact with an insulating layer (typically a non-conducting layer) which is surrounded by and in contact with a second semiconductive shield layer which is surrounded by and in contact with a metallic wire or tape shield (used as a ground) which is surrounded by and in contact with a protective jacket (which may or may not be semiconductive). Additional layers within this construction, e.g., moisture barriers, additional insulation and/or semiconductor layers, etc., are often included. Typically each insulation layer is in contact with at least one semiconductor layer.

Olefin Block Copolymer (OBC)

"Olefin block copolymer", olefin block interpolymer", "multi-block interpolymer", "segmented interpolymer" and like terms refer to a polymer comprising two or more chemically distinct regions or segments (referred to as "blocks") preferably joined in a linear manner, that is, a polymer comprising chemically differentiated units which are joined end-to-end with respect to polymerized olefinic, preferable ethylenic, functionality, rather than in pendent or grafted fashion. In a preferred embodiment, the blocks differ in the amount or type of incorporated comonomer, density, amount of crystallinity, crystallite size attributable to a polymer of such composition, type or degree of tacticity (isotactic or syndiotactic), regio-regularity or regio-irregularity, amount of branching (including long chain branching or hyper-branching), homogeneity or any other chemical or physical property. Compared to block interpolymers of the prior art, including interpolymers produced by sequential monomer addition, fluxional catalysts, or anionic polymerization techniques, the multi-block interpolymers used in the practice of this invention are characterized by unique distributions of both polymer polydispersity (PDI or Mw/Mn or MWD), block length distribution, and/or block number distribution, due, in a preferred embodiment, to the effect of the shuttling agent(s) in combination with multiple catalysts used in their preparation. More specifically, when produced in a continuous process, the polymers desirably possess PDI from 1.7 to 3.5, preferably from 1.8 to 3, more preferably from 1.8 to 2.5, and most preferably from 1.8 to 2.2. When produced in a batch or semi-batch process, the polymers desirably possess PDI from 1.0 to 3.5, preferably from 1.3 to 3, more preferably from 1.4 to 2.5, and most preferably from 1.4 to 2.

The term "ethylene multi-block interpolymer" means a multi-block interpolymer comprising ethylene and one or more interpolymerizable comonomers, in which ethylene comprises a plurality of the polymerized monomer units of at least one block or segment in the polymer, preferably at least 90, more preferably at least 95 and most preferably at least 98, mole percent of the block. Based on total polymer weight, the ethylene multi-block interpolymers used in the practice of the present invention preferably have an ethylene content from 25 to 97, more preferably from 40 to 96, even more preferably from 55 to 95 and most preferably from 65 to 85, percent.

Because the respective distinguishable segments or blocks formed from two of more monomers are joined into single polymer chains, the polymer cannot be completely fractionated using standard selective extraction techniques. For example, polymers containing regions that are relatively crystalline (high density segments) and regions that are relatively amorphous (lower density segments) cannot be selectively extracted or fractionated using differing solvents. In a preferred embodiment the quantity of extractable polymer using either a dialkyl ether or an alkane-solvent is less than 10, preferably less than 7, more preferably less than 5 and most preferably less than 2, percent of the total polymer weight.

In addition, the multi-block interpolymers used in the practice of the invention desirably possess a PDI fitting a Schutz-Flory distribution rather than a Poisson distribution. The use of the polymerization process described in WO 2005/090427 and U.S. Ser. No. 11/376,835 results in a product having both a polydisperse block distribution as well as a polydisperse distribution of block sizes. This results in the formation of polymer products having improved and distinguishable physical properties. The theoretical benefits of a polydisperse block distribution have been previously modeled and discussed in Potemkin, Physical Review E (1998) 57 (6), pp. 6902-6912, and Dobrynin, J. Chem. Phys. (1997) 107 (21), pp 9234-9238.

In a further embodiment, the polymers of the invention, especially those made in a continuous, solution polymerization reactor, possess a most probable distribution of block lengths. In one embodiment of this invention, the ethylene multi-block interpolymers are defined as having:

(A) Mw/Mn from about 1.7 to about 3.5, at least one melting point, Tm, in degrees Celsius, and a density, d, in grams/cubic centimeter, where in the numerical values of Tm and d correspond to the relationship $Tm>-2002.9+4538.5(d)-2422.2(d)^2$, or (B) Mw/Mn from about 1.7 to about 3.5, and is characterized by a heat of fusion, ΔH in J/g, and a delta quantity, ΔT, in degrees Celsius defined as the temperature difference between the tallest DSC peak and the tallest CRYSTAF peak, wherein the numerical values of ΔT and AH have the following relationships:

$\Delta T>-0.1299(\Delta H)+62.81$ for ΔH greater than zero and up to 130 J/g $\Delta T>48°$ C. for ΔH greater than 130 J/g wherein the CRYSTAF peak is determined using at least 5 percent of the cumulative polymer, and if less than 5 percent of the polymer has an identifiable CRYSTAF peak, then the CRYSTAF temperature is 30° C.; or (C) Elastic recovery, Re, in percent at 300 percent strain and 1 cycle measured with a compression-molded film of the ethylene/α-olefin interpolymer, and has a density, d, in grams/cubic centimeter, wherein the numerical values of Re and d satisfy the following relationship when ethyleneαolefin interpolymer is substantially free of cross-linked phase:

$$Re>1481-1629(d);\text{ or}$$

(D) Has a molecular weight fraction which elutes between 40° C. and 130° C. when fractionated using TREF, characterized in that the fraction has a molar comonomer content of at least 5 percent higher than that of a comparable random ethylene interpolymer fraction eluting between the same temperatures, wherein the comparable random ethylene interpolymer has the same comonomer(s) and has a melt index, density and molar comonomer content (based on the whole polymer) within 10 percent of that of the ethylene/α-olefin interpolymer; or (E) Has a storage modulus at 25° C., G'(25° C.), and a storage modulus at 100° C., G'(100° C.), wherein the ratio of G'(25° C.) to G'(100° C.) is in the range of about 1:1 to about 9:1.

The ethylene/.alpha.-olefin interpolymer may also have:

(F) Molecular fraction which elutes between 40° C. and 130° C. when fractionated using TREF, characterized in that the fraction has a block index of at least 0.5 and up to about 1 and a molecular weight distribution, Mw/Mn, greater than about 1.3; or (G) Average block index greater than zero and up to about 1.0 and a molecular weight distribution, Mw/Mn greater than about 1.3.

Suitable monomers for use in preparing the ethylene multi-block interpolymers used in the practice of this present invention include ethylene and one or more addition polymerizable monomers other than ethylene. Examples of suitable comonomers include straight-chain or branched α-olefins of 3 to 30, preferably 3 to 20, carbon atoms, such as propylene, 1-butene, 1-pentene, 3-methyl-1-butene, 1-hexene, 4-methyl-1-pentene, 3-methyl-1-pentene, 1-octene, 1-decene, 1-dodecene, 1-tetradecene, 1-hexadecene, 1-octadecene and 1-eicosene; cyclo-olefins of 3 to 30, preferably 3 to 20, carbon atoms, such as cyclopentene, cycloheptene, norbornene, 5-methyl-2-norbornene, tetracyclododecene, and 2-methyl-1,4,5,8-dimethano-1,2,3,4,4a,5,8,8a-octahydronaphthalene; di- and polyolefins, such as butadiene, isoprene, 4-methyl-1,3-pentadiene, 1,3-pentadiene, 1,4-pentadiene, 1,5-hexadiene, 1,4-hexadiene, 1,3-hexadiene, 1,3-octadiene, 1,4-octadiene, 1,5-octadiene, 1,6-octadiene, 1,7-octadiene, ethylidenenorbornene, vinyl norbornene, dicyclopentadiene, 7-methyl-1,6-octadiene, 4-ethylidene-8-methyl-1,7-nonadiene, and 5,9-dimethyl-1,4,8-decatriene; and 3-phenylpropene, 4-phenylpropene, 1,2-difluoroethylene, tetrafluoroethylene, and 3,3,3-trifluoro-1-propene.

Other ethylene multi-block interpolymers that can be used in the practice of this invention are elastomeric interpolymers of ethylene, a $C_{3-20}$ α-olefin, especially propylene, and, optionally, one or more diene monomers. Preferred α-olefins for use in this embodiment of the present invention are designated by the formula $CH_2{=}CHR^*$, where R* is a linear or branched alkyl group of from 1 to 12 carbon atoms. Examples of suitable α-olefins include, but are not limited to, propylene, isobutylene, 1-butene, 1-pentene, 1-hexene, 4-methyl-1-pentene, and 1-octene. One particularly preferred α-olefin is propylene. The propylene based polymers are generally referred to in the art as EP or EPDM polymers. Suitable dienes for use in preparing such polymers, especially multi-block EPDM type-polymers include conjugated or non-conjugated, straight or branched chain-, cyclic- or polycyclic dienes containing from 4 to 20 carbon atoms. Preferred dienes include 1,4-pentadiene, 1,4-hexadiene, 5-ethylidene-2-norbornene, dicyclopentadiene, cyclohexadiene, and 5-butylidene-2-norbornene. One particularly preferred diene is 5-ethylidene-2-norbornene.

Because the diene containing polymers contain alternating segments or blocks containing greater or lesser quantities of the diene (including none) and α-olefin (including none), the total quantity of diene and α-olefin may be reduced without loss of subsequent polymer properties. That is, because the diene and α-olefin monomers are preferentially incorporated into one type of block of the polymer rather than uniformly or randomly throughout the polymer, they are more efficiently utilized and subsequently the crosslink density of the polymer can be better controlled. Such crosslinkable elastomers and the cured products have advantaged properties, including higher tensile strength and better elastic recovery.

The ethylene multi-block interpolymers useful in the practice of this invention have a density of less than 0.90, preferably less than 0.89, more preferably less than 0.885, even more preferably less than 0.88 and even more preferably less than 0.875, g/cc. The ethylene multi-block interpolymers typically have a density greater than 0.85, and more preferably greater than 0.86, g/cc. Density is measured by the procedure of ASTM D-792. Low density ethylene multi-block interpolymers are generally characterized as amorphous, flexible and having good optical properties, e.g., high transmission of visible and UV-light and low haze.

The ethylene multi-block interpolymers useful in the practice of this invention typically have a melt flow rate (MFR) of at least 1 gram per 10 minutes (g/10 min), more typically of at least 2 g/10 min and even more typically at least 3 g/10 min, as measured by ASTM D1238 (190° C./2.16 kg). The maximum MFR is typically not in excess of 60 g/10 min, more typically not in excess of 57 g/10 min and even more typically not in excess of 55 g/10 min.

The ethylene multi-block interpolymers useful in the practice of this invention have a 2% secant modulus of less than about 150, preferably less than about 140, more preferably less than about 120 and even more preferably less than about 100, MPa as measured by the procedure of ASTM D-882-02. The ethylene multi-block interpolymers typically have a 2% secant modulus of greater than zero, but the lower the modulus, the better the interpolymer is adapted for use in this invention. The secant modulus is the slope of a line from the origin of a stress-strain diagram and intersecting the curve at a point of interest, and it is used to describe the stiffness of a material in the inelastic region of the diagram. Low modulus ethylene multi-block interpolymers are particularly well adapted for use in this invention because they provide stability under stress, e.g., less prone to crack upon stress or shrinkage.

The ethylene multi-block interpolymers useful in the practice of this invention typically have a melting point of less than about 125. The melting point is measured by the differential scanning calorimetry (DSC) method described in WO 2005/090427 (US2006/0199930). Ethylene multi-block interpolymers with a low melting point often exhibit desirable flexibility and thermoplasticity properties useful in the fabrication of the wire and cable sheathings of this invention.

The ethylene multi-block interpolymers used in the practice of this invention, and their preparation and use, are more fully described in U.S. Pat. No. 7,579,408, 7,355,089, 7,524,911, 7,514,517, 7,582,716 and 7,504,347.

The OBC of the semiconductor layer is crosslinked, typically through the use of a peroxide crosslinking (curing) agent. Examples of peroxide curing agents include, but are not limited to: dicumyl peroxide; bis(alpha-t-butyl peroxyisopropyl)benzene; isopropylcumyl t-butyl peroxide; t-butylcumylperoxide; di-t-butyl peroxide; 2,5-bis(t-butylperoxy)2,5-dimethylhexane; 2,5-bis(t-butylperoxy)-2,5-dimethylhexyne-3; 1,1-bis(t-butylperoxy)3,3,5-trimethylcyclohexane; isopropylcumyl cumylperoxide; di(isopropylcumyl)peroxide; and mixtures of two or more of these agents. Peroxide curing agents can be used in amounts of 0.1 to 5 wt % based on the weight of the composition. Various other known curing co-agents, boosters, and retarders, can be used, such as triallyl isocyanurate; ethoxylated bisphenol A dimethacrylate; alpha methyl styrene dimer; and other co-agents described in U.S. Pat. Nos. 5,346,961 and 4,018,852. In one embodiment the semiconductor layer is crosslinked through the use of radiation curing.

The composition (comprising OBC and filler) from which the semiconductor layer is made exhibits one or both of the following properties during crosslinking:

1. MH (maximum torque at 182° C.)–ML (minimum torque at 182° C.) >1 lb-in, preferably >1.5 lb-in, most preferably >2.0 lb-in; and/or 2. ts1 (time for 1 lb-in increase in torque) at 140° C. >20 min, preferably >22 min, most preferably >25 min.

Upon crosslinking, the filled semiconductor layer used in the practice of this invention will exhibit one or more, or two or more, or three or more, or four or more, or five or more, or, preferably, all six of the following properties:

1. Thermo-Mechanical Analysis (TMA), 0.1 mm probe penetration temperature >85° C., preferably >90° C., most preferably >95° C.;

2. Gel content >30%, preferably >35%, most preferably >40% (after crosslinking);

3. Volume Resistivity at 23° C. <50,000 ohm-cm, preferably <10,000 ohm-cm, most preferably <5,000 ohm-cm;

4. Volume Resistivity at 90° C. <50,000 ohm-cm, preferably <25,000 ohm-cm, most preferably <5,000 ohm-cm;

5. Volume Resistivity at 130° C. <50,000 ohm-cm, preferably <45,000 ohm-cm, most preferably <40,000 ohm-cm; and/or 6. Density <1.5 g/cm$^3$, preferably <1.4 g/cm$^3$, most preferably <1.3 g/cm$^3$.

When in a sandwich construction in which two like, filled, crosslinked semiconductor layers are in contact with an insulation layer, the construction exhibits one or both of the following properties:

1. Shore D (on a 250 mil thick specimen consisting of three layers: semiconductor composition (50 mil), XLPE insulation (150 mil), semiconductor composition (50 mil)) >22, preferably >24, most preferably >26 at 95° C. and 110° C.; and/or 2. Shore A (on a 250 mil thick specimen consisting of three layers: semiconductor composition (50 mil), XLPE insulation (150 mil), semiconductor composition (50 mil)) >80, preferably >84, most preferably >88 at 95° C. and 110° C.

Conductive Filler

Any conductive filler can be used in the practice of this invention. Exemplary conductive fillers include carbon black, graphite, metal oxides and the like. In one embodiment the conductive filler is a carbon black with an arithmetic mean particle size larger than 29 nanometers.

Insulation Layer

The insulation layer typically comprises a polyolefin polymer. Polyolefin polymers used for the insulation layers of medium and high voltage power cables are typically made at high pressure in reactors that are typically tubular or autoclave in design, but these polymers can also be made in low-pressure reactors. The polyolefins used in the insulation layer can be produced using conventional polyolefin polymerization technology, e.g., Ziegler-Natta, metallocene or constrained geometry catalysis. Preferably, the polyolefin is made using a mono- or bis-cyclopentadienyl, indenyl, or fluorenyl transition metal (preferably Group 4) catalysts or constrained geometry catalysts (CGC) in combination with an activator, in a solution, slurry, or gas phase polymerization process. The catalyst is preferably mono-cyclopentadienyl, mono-indenyl or mono-fluorenyl CGC. The solution process is preferred. U.S. Pat. No. 5,064,802, WO 93/19104 and WO 95/00526 disclose constrained geometry metal complexes and methods for their preparation. Variously substituted indenyl containing metal complexes are taught in WO 95/14024 and WO 98/49212.

The polyolefin polymer can comprise at least one resin, or blends of two or more resins, having melt index (MI, $I_2$) from 0.1 to 50 grams per 10 minutes (g/10 min) and a density between 0.85 and 0.95 grams per cubic centimeter (g/cc). Typical polyolefins include high pressure low density polyethylene, high density polyethylene, linear low density polyethylene metallocene linear low density polyethylene, and CCC ethylene polymers. Density is measured by the procedure of ASTM D-792 and melt index is measured by ASTM D-1238 (190° C./2.16 kg).

In another embodiment, the polyolefin polymer includes but is not limited to copolymers of ethylene and unsaturated esters with an ester content of at least 5 wt % based on the weight of the copolymer. The ester content is often as high as 80 wt %, and, at these levels, the primary monomer is the ester.

In still another embodiment, the range of ester content is 10 to 40 wt % . The percent by weight is based on the total weight of the copolymer. Examples of the unsaturated esters are vinyl esters and acrylic and methacrylic acid esters. The ethylene/unsaturated ester copolymers usually are made by conventional high pressure processes. The copolymers can have a density in the range of 0.900 to 0.990 g/cc. In yet another embodiment, the copolymers have a density in the range of 0.920 to 0.950 g/cc. The copolymers can also have a melt index in the range of 1 to 100 g/10 min. In still another embodiment, the copolymers can have a melt index in the range of 5 to 50 g/10 min.

The ester can have 4 to 20 carbon atoms, preferably 4 to 7 carbon atoms. Examples of vinyl esters are: vinyl acetate; vinyl butyrate; vinyl pivalate; vinyl neononanoate; vinyl neodecanoate; and vinyl 2-ethylhexanoate. Examples of acrylic and methacrylic acid esters are: methyl acrylate; ethyl acrylate; t-butyl acrylate; n-butyl acrylate; isopropyl acrylate; hexyl acrylate; decyl acrylate; lauryl acrylate; 2-ethylhexyl acrylate, lauryl methacrylate; myristyl methacrylate; palmityl methacrylate; stearyl methacrylate; 3-methacryloxy-propyltrimethoxy si lane; 3-methacryloxy-propyltriethoxysilane; cyclohexyl methacrylate; n-hexyl-methacrylate; isodecyl methacrylate; 2-methoxyethyl methacrylate: tetrahydrofurfuryl methacrylate; octyl methacrylate; 2-phenoxyethyl methacrylate; isobornyl methacrylate; isooctylmethacrylate; isooctyl methacrylate; and oleyl methacrylate. Methyl acrylate, ethyl acrylate, and n- or t-butyl acrylate are preferred. In the case of alkyl acrylates and methacrylates, the alkyl group can have 1 to 8 carbon atoms, and preferably has 1 to 4 carbon atoms. The alkyl group can be substituted with an oxyalkyltrialkoxysilane.

Other examples of polyolefin polymers are: polypropylene; polypropylene copolymers; polybutene; polybutene copolymers; highly short chain branched .alpha.-olefin copolymers with ethylene co-monomer less than 50 mole percent but greater than 0 mole percent; polyisoprene; polybutadiene; EPR (ethylene copolymerized with propylene); EPDM (ethylene copolymerized with propylene and a diene such as hexadiene, dicyclopentadiene, or ethylidene norbornene); copolymers of ethylene and an α-olefin having 3 to 20 carbon atoms such as ethylene/octene copolymers; terpolymers of ethylene, .α-olefin, and a diene (preferably non-conjugated); terpolymers of ethylene, .α-olefin, and an unsaturated ester; copolymers of ethylene and vinyl-tri-alkyloxy slime; terpolymers of ethylene, vinyl-tri-alkyloxy silane and an unsaturated ester; or copolymers of ethylene and one or more of acrylonitrile or maleic acid esters.

The polyolefin polymer of the insulation layer may also include ethylene ethyl acrylate, ethylene vinyl acetate, vinyl ether, ethylene vinyl ether, and methyl vinyl ether.

The polyolefin polymer of the insulation layer includes but is not limited to a polypropylene copolymer comprising at least 50 mole percent units derived from propylene and the remainder from units from at least one α-olefin having up to 20, preferably up to 12 and more preferably up to 8, carbon atoms, and a polyethylene copolymer comprising at least 50 mole percent units derived from ethylene and the remainder from units derived from at least one α-olefin having up to 20, preferably up to 12 and more preferably up to 8, carbon atoms.

The polyolefin copolymers useful in the insulation layers also include the ethylene/α-olefin interpolymers previously described. Generally, the greater the α-olefin content of the interpolymer, the lower the density and the more amorphous the interpolymer, and this translates into desirable physical and chemical properties for the protective insulation layer.

The polyolefins used in the insulation layer of the cables of this invention can be used alone or in combination with one or more other polyolefins, e.g., a blend of two or more polyolefin polymers that differ from one another by monomer composition and content, catalytic method of preparation, etc. If the polyolefin is a blend of two or more polyolefins, then the polyolefin can be blended by any in-reactor or post-reactor process. The in-reactor blending processes are preferred to the post-reactor blending processes, and the processes using multiple reactors connected in series are the preferred in-reactor blending processes. These reactors can be charged with the same catalyst but operated at different conditions, e.g., different reactant concentrations, temperatures, pressures, etc, or operated at the same conditions but charged with different catalysts.

Exemplary polypropylenes useful in the practice of this invention include the VERSIFY™ polymers available from The Dow Chemical Company, and the VISTAMAXX™ polymers available from ExxonMobil Chemical Company. A complete discussion of various polypropylene polymers is contained in *Modern Plastics Encyclopedia/*89, mid October 1988 Issue, Volume 65, Number 11, pp. 6-92.

Additives

Both the semiconductor and insulation layers of the present invention also can comprise conventional additives including but not limited to antioxidants, curing agents, crosslinking co-agents, boosters and retardants, processing aids, fillers, coupling agents, ultraviolet absorbers or stabilizers, antistatic agents, nucleating agents, slip agents, plasticizers, lubricants, viscosity control agents, tackifiers, anti-blocking agents, surfactants, extender oils, acid scavengers, and metal deactivators. Additives other than fillers can be used in amounts ranging from less than 0.01 to more than 10 wt %, typically 0.01 to 10 wt % and more typically 0.01 to 5 wt %, based on the weight of the composition. Fillers can be used in amounts ranging from less than 0.01 to more than 50 wt %, typically 1 to 50 wt % and more typically 10 to 50 wt %, based on the weight of the composition.

Compounding

The materials that comprise the semiconductor and insulation layers can be compounded or mixed by standard means known to those skilled in the art. Examples of compounding equipment are internal batch mixers, such as a BANBURY™ or BOLLING™ internal mixer. Alternatively, continuous single, or twin screw, mixers can be used, such as FARREL™ continuous mixer, a WERNER AND PFIEIDERER™ twin screw mixer, or a BUSS™ kneading continuous extruder. The type of mixer utilized, and the operating conditions of the mixer, can affect the properties of a semiconducting and insulative material such as viscosity, volume resistivity, and extruded surface smoothness.

A cable comprising a conductor, a semiconductor layer and an insulation layer can be prepared in various types of extruders, e.g., single or twin screw types. A description of a conventional extruder can be found in U.S. Pat. No. 4,857,600. An example of co-extrusion and an extruder for co-extrusion can be found in U.S. Pat. No. 5,575,965. A typical extruder has a hopper at its upstream end and a die at its downstream end. The hopper feeds into a barrel, which contains a screw. At the downstream end, between the end of the screw and the die, is a screen pack and a breaker plate. The screw portion of the extruder is considered to be divided into three sections, the feed section, the compression section, and the metering section, and two zones, the back heat zone and the front heat zone, the sections and zones running from upstream to downstream. In the alternative, there can be multiple heating zones (more than two) along the axis running from upstream to downstream. If it has more than one barrel, the barrels are connected in series. The length to diameter ratio of each barrel is in the range of 1.5:1 to 30:1. In wire coating in which the one or more of the layers is crosslinked after extrusion, the cable often passes immediately into a heated vulcanization zone downstream of the extrusion die. The heated cure zone can be maintained at a temperature in the range of 200 to 350° C., preferably in the range of about 170 to 250° C. The heated zone can be heated by pressurized steam, or inductively heated pressurized nitrogen gas.

Degassing

Degassing is a process by which the by-products of the crosslinking reaction are removed from the cable. The by-products can negatively affect cable performance. For example, the presence of crosslinking by-products in the cable can result in increased dielectric loss, increase in gas pressures leading to displacement of terminations and joints as well as distortion of metallic foil sheaths, and masking of production defects that may lead to failure of cables in service. Prior to jacketing, high voltage (HV) and extra-high voltage (EHV) cable cores containing only the conductor, semiconductive shields and insulation layers undergo thermal treatment at elevated temperatures, typically between 50° C. and 80° C., to increase the diffusion rate of the by-products. Long times at ambient conditions (23° C. and atmospheric pressure) are often ineffective for degassing HV and EHV cables. Degassing is typically performed in large heated chambers that are well ventilated to avoid build-up of flammable methane and ethane. Generally, the by-products of methane, ethane, acetophenone, alpha-methyl styrene and cumyl alcohol are removed.

Specific Embodiments

Formulations and Sample Preparation

The compositions are shown in Table 1. The properties of the OBC resins are shown in Table 5. Samples are compounded in a 375 $cm^3$ BRABENDER™ batch mixer at 120° C. and 35 revolutions per minute (rpm) for 5 minutes except for Comparative Example 3 that is mixed at 125° C. and 40 rpm for 5 minutes. The polymer resin, carbon black, and additives are loaded into the bowl and allowed to flux and mix for 5 minutes. After 5 minutes, the rpm is lowered to 10 and batch mixer temperature is allowed to return to 120° C. for peroxide addition. Melted peroxide is added and mixed for 5 minutes at 10 rpm.

Samples are removed from the mixer and pressed to various thicknesses for testing. For electrical and physical measurements, plaques are compression molded and crosslinked in the press. The samples are pressed under 500 pounds per square inch (psi) pressure at 125° C. for 3 minutes, and then the press was raised to 175° C. and 2,500 psi pressure for a cure time of 15 minutes. After 15 minutes the press is cooled to 30° C. at 2,500 psi. Once at 30° C., the press is opened and the plaque is removed. For crosslinking experiments including MDR and gel content, samples directly from the mixer are used and crosslinked during the test.

The properties of the compositions are given in Table 2. Unlike the comparative examples, Examples 1-6 exhibited the desired combination of properties (as previously described) for the manufacture and use of power cable semiconductive shield in an improved degassing process: Acceptably high deformation-resistance and temperature-resistance (i.e., TMA, 0.1 mm probe penetration temperature and Shore A and D as a function of temperature; for higher temperature degassing) while maintaining acceptably low volume resistivity, acceptably high scorch-resistance at extrusion conditions, acceptably high degree of crosslinking after extrusion, and acceptable dissipation factor of XLPE insulation after being in contact with the inventive semiconductive shield (Tables 2, 3, and 4).

Test Methods

Temperature-dependent probe penetration experiments are performed using a TA instrument Thermo-Mechanical Analyzer (TMA) on samples (prepared by compression molding at 160° C. for 120 minutes). The sample is cut into an 8 mm disk (thickness 1.5 mm). A 1 mm diameter cylindrical probe is brought to the surface of the sample and a force of 1 N (102 g) is applied. As the temperature is varied from 30° C. to 220° C. at a rate of 5° C./min, the probe penetrates into the sample due to the constant load and the rate of displacement is monitored. The test ends when the penetration depth reaches 1 mm.

Shore hardness is determined in accordance with ASTM D 2240, on specimens of 250 mil thickness. The final specimen is a 2 inch diameter, multilayered disk consisting of a 50 mil thick semiconductive layer from the specified compositions in Table 1, a 150 mil thick XLPE insulation layer, and another 50 mil thick semiconductive layer of the same composition on top. The semiconductive layer and XLPE are first pressed into 4 inch by 4 inch plaques under 500 psi pressure at 125° C. for 3 minutes and then 2,500 psi pressure for 3 minutes at 50 mil and 150 mil thicknesses, respectively. Then, 2 inch diameter disks of each material are cut from the uncured plaque, placed in the mold sequentially (semiconductor layer, insulation layer, semiconductor layer) and pressed under 500 psi pressure at 125° C. for 3 minutes, and then the press was raised to 180° C. and 2,500 psi pressure for a cure time of 15 minutes. After 15 minutes the press is cooled to 30° C. at 2,500 psi pressure. Each sample is heated to temperature and held for 1.5 hours and then immediately tested. The average of 4 measurements is reported, along with the standard deviation.

Volume resistivity is tested according to ASTM D991. Testing is performed on 75 mil cured plaque specimens. Testing is conducted at room temperature (20-25° C.), 90° C. and 130° C. for 30 days.

Moving Die Rheometer (MDR) analyses are performed on the compounds using Alpha Technologies Rheometer MDR model 2000 unit. Testing is based on ASTM procedure D 5289, "Standard Test Method for Rubber—Property Vulcanization Using Rotorless Cure Meters". The MDR analyses are performed using 4 grams of material. Samples are tested at 182° C. for 12 minutes and at 140° C. for 90 minutes at 0.5 degrees arc oscillation for both temperature conditions. Samples are tested on material directly from the mixing bowl, Gel content (insoluble fraction) produced in ethylene plastics by crosslinking can be determined by extracting with the solvent decahydronaphthalene (Decalin) according to ASTM D2765. It is applicable to cross-linked ethylene plastics of all densities, including those containing fillers, and all provide corrections for the inert fillers present in some of those compounds. The test is conducted on specimens that come out of the MDR experiments at 182° C. A Wiley mill is used (20 mesh screen) to prepare powdered samples, at least one gram of material for each sample. Fabrication of the sample pouches is crafted carefully to avoid leaks of the powdered samples from the pouch. In any technique used, losses of powder to leaks around the folds or through staple holes are to be avoided. The width of the finished pouch is no more than three quarters of an inch, and the length is no more than two inches (120 mesh screens are used for pouches). The sample pouch is weighed on an analytical balance. About 0.3 grams (+/−0.02 grams) of powdered samples, is placed into the pouch. Since it was necessary to pack the sample into the pouch, care is given not to force open the folds in the pouch. The pouches are sealed and samples are then weighed. Samples are then placed into 1 liter of boiling decahydronaphthalene, with 10 grams of AO-2246 for 6 hours using flasks in heated mantle. After the Decalin is boiled for six hours, the voltage regulator is turned off leaving the cooling water running until Decalin is cooled below its flash point. This can take at least a half hour. When the Decalin is cooled, the cooling water is turned off and the pouches removed from the flasks. The pouches are allowed to cool under a hood to remove as much solvent as possible. Then the pouches are then placed in a vacuum oven set at 150° C. for four hours, maintaining a vacuum of 25 inches of mercury. The pouches are then taken out of the oven and allowed to cool to room temperature (20-25° C.). Weights are recorded on an analytical balance. The calculation for gel extraction is shown below where W1=weight of empty pouch, W2=weight of sample and pouch, W3=weight of sample, pouch and staple, and W4=weight after extraction.

$$\% \text{ extracted} = \left(\frac{W_3 - W_4}{W_2 - W_1}\right) \times 100$$

$$\text{Gel Content} = 100 - \% \text{ extracted}$$

Dissipation factor (DF) of XLPE after contact with the semiconductive shield is conducted on molded samples. The DF is a measure of dielectric loss in the material. The higher the DF, the more lossy the material or greater the dielectric loss. The DF units are radians. Four XLPE samples are molded into 40 mil thick disks following the press procedure above. The samples are degassed for 5 days at 60° C. and DF is measured. Samples (4"×4"×0.050") of the semiconductor are pressed and crosslinked following the procedure above. The original XLPE disks are put in contact with the semiconductor sample in an oven for 4 hours at 100° C. After 4 hours, the DF of the XLPE disk is tested to evaluate the change in DF after being in contact with resins containing catalyst components.

TABLE 1

Compositions

| Composition (wt %) | Comparative Exp 1 | Comparative Exp 2 | Comparative Exp 3 | Exp 1 | Exp 2 | Exp 3 | Exp 4 | Exp 5 | Exp 6 |
|---|---|---|---|---|---|---|---|---|---|
| Ethylene Ethyl Acrylate | 27.8 | 31.6 | | | | | | | |
| ENGAGE 8411 POE | 36.8 | 41.9 | | | | | | | |
| OBC 1 (0.4MI, 0.8982 den, 65% Hard Seg) | | | 73.5 | | | | 36.7 | | |
| OBC 2 (25MI, 0.8849 den, 35% Hard Seg) | | | | 73.5 | | | 36.7 | | |
| OBC 4 (28MI, 0.8709 den, 20% Hard Seg) | | | | | 73.5 | | | | |
| OBC 3 (39MI, 0.8783 den, 29% Hard Seg) | | | | | | 73.5 | | | |
| OBC 5 (5.7MI, 0.8689 den, 20% Hard Seg, 25% CB) | | | | | | | | 73.5 | |
| OBC 6 (9.5MI, 0.896 den, 54% Hard Seg, 25% CB) | | | | | | | | | 73.5 |
| Carbon Black | 33.7 | 24.8 | 24.8 | 24.8 | 24.8 | 24.8 | 24.8 | 24.8 | 24.8 |
| 2,2,4-Trimethyl-1,2-Hydroquinoline | 0.8 | 0.8 | 0.8 | 0.8 | 0.8 | 0.8 | 0.8 | 0.8 | 0.8 |
| a,a'-bis(tert-butylperoxy)-diisopropylbenzene | 1.0 | 1.0 | 1.0 | 1.0 | 1.0 | 1.0 | 1.0 | 1.0 | 1.0 |
| Total | 100 | 100 | 100 | 100 | 100 | 100 | 100 | 100 | 100 |
| Density, g/cm$^3$ | 1.09 | 1.04 | 1.05 | 1.04 | 1.03 | 1.03 | 1.04 | 1.03 | 1.05 |

TABLE 2

Properties

| | Comparative Exp 1 | Comparative Exp 2 | Comparative Exp 3 | Exp 1 | Exp 2 | Exp 3 | Exp 4 | Exp 5 | Exp 6 |
|---|---|---|---|---|---|---|---|---|---|
| MDR-MH (182° C.,12 min), in-lb | 8.32 | 5.55 | 12.85 | 3.25 | 2.60 | 2.22 | 7.53 | 4.94 | 5.45 |
| MDR-ML (182° C.,12 min), in-lb | 0.81 | 0.28 | 0.97 | 0.15 | 0.16 | 0.13 | 0.36 | 0.42 | 0.15 |
| MH-ML, in-lb | 7.5 | 5.3 | 11.9 | 3.1 | 2.4 | 2.1 | 7.2 | 4.5 | 5.3 |
| MDR, ts1 (140° C., 90 min) | 46.6 | 59.3 | 6.7 | >90 | >90 | >90 | 26.8 | 45.5 | 47.9 |
| Gel Content, % | 40.7 | 45.3 | 82.7 | 35.7 | 59.4 | 33.0 | 56.5 | 74.8 | 50.9 |
| TMA, 0.1 mm Change, ° C. | 79 | 73 | 115 | 103 | 93 | 100 | 111 | 92 | 109 |
| Volume Resistivity, ohm-cm (23° C.) | 44 | 100 | 3,575 | 834 | 1,027 | 257 | 4,767 | 552 | 143 |
| Volume Resistivity, ohm-cm (90° C.) | 442 | 1306 | 16,394,557 | 660 | 2,033 | 1,364 | 10,152 | 1,396 | 1,573 |

TABLE 2-continued

| Properties | | | | | | | | | |
|---|---|---|---|---|---|---|---|---|---|
| | Comparative Exp 1 | Comparative Exp 2 | Comparative Exp 3 | Exp 1 | Exp 2 | Exp 3 | Exp 4 | Exp 5 | Exp 6 |
| Volume Resistivity, ohm-cm (130° C.) | 457 | 548 | 756,890 | 8,705 | 8,989 | 15,238 | 17,381 | 7,077 | 35,479 |

TABLE 3

| Shore A and Shore D as a Function of Temperature | | | | |
|---|---|---|---|---|
| | Temp, ° C. | Comparative Example 1 | Comparative Example 2 | Example 6 |
| Shore D | 23 | 44.8 ± 0.1 | 40.0 ± 0.3 | 43.5 ± 0.5 |
| | 50 | 43.0 ± 1.4 | 37.3 ± 1.0 | 41.2 ± 1.6 |
| | 65 | 39.7 ± 1.5 | 33.6 ± 2.3 | 39.0 ± 1.3 |
| | 80 | 33.2 ± 3.9 | 28.7 ± 2.1 | 36.5 ± 1.7 |
| | 95 | 22.8 ± 2.5 | 19.4 ± 1.7 | 31.5 ± 2.0 |
| | 110 | 17.8 ± 1.5 | 14.8 ± 1.7 | 26.5 ± 3.4 |
| Shore A | 23 | 97.0 ± 0.3 | 94.7 ± 0.1 | 98.1 ± 0.3 |
| | 50 | 95.2 ± 0.5 | 93.0 ± 0.4 | 97.7 ± 0.5 |
| | 65 | 93.0 ± 0.9 | 89.1 ± 1.9 | 95.3 ± 1.1 |
| | 80 | 87.8 ± 2.3 | 82.8 ± 3.0 | 94.4 ± 1.2 |
| | 95 | 75.8 ± 3.0 | 70.6 ± 4.7 | 92.3 ± 2.0 |
| | 110 | 67.9 ± 4.0 | 62.7 ± 4.1 | 88.1 ± 2.4 |

TABLE 4

| XLPE DF Before and After Contact with Semiconductor | | | | |
|---|---|---|---|---|
| DF (in radians) of XLPE Before Migration | | | | |
| Temp, ° C. | XLPE | XLPE (DF before contact with Comp 1) | XLPE (DF before contact with Comp 2) | XLPE (DF before contact with Exp 6) |
| 25 | 0.000307 | 0.000309 | 0.000315 | 0.000287 |
| 40 | 0.000207 | 0.000182 | 0.000164 | 0.000182 |
| 90 | 0.000103 | 0.000115 | 0.000107 | 0.000112 |
| 130 | 0.000416 | 0.000326 | 0.000308 | 0.000292 |
| DF (in radians) of XLPE After Migration | | | | |
| Temp, ° C. | XLPE | XLPE (DF after contact with Comp 1) | XLPE (DF after contact with Comp 2) | XLPE (DF after contact with Exp 6) |
| 25 | 0.00029 | 0.00034 | 0.00028 | 0.00025 |
| 40 | 0.00016 | 0.00016 | 0.00020 | 0.00016 |
| 90 | 0.00010 | 0.00011 | 0.00021 | 0.00010 |
| 130 | 0.00053 | 0.00059 | 0.00281 | 0.00059 |

TABLE 5

| Properties of the OBC Resins | | | | | | |
|---|---|---|---|---|---|---|
| OBC Resin | Density g/cc | I2 (190° C.) g/10 min | Soft Seg. C8 mol % | Hard Seg. C8 mol % | % Soft Seg. wt % | % Hard Seg. wt % |
| OBC 1 | 0.898 | 0.4 | 32.4 | 1.81 | 35 | 65 |
| OBC 2 | 0.885 | 25 | 22.8 | 1.14 | 65 | 35 |
| OBC 3 | 0.878 | 39 | 26.3 | 1.37 | 71 | 29 |
| OBC 4 | 0.871 | 28 | 30.1 | 1.63 | 80 | 20 |
| OBC 5 | 0.869 | 5.7 | 29.4 | 1.58 | 80 | 20 |
| OBC 6 | 0.896 | 9.5 | 29.3 | 1.57 | 46 | 54 |

Residues in polymers prepared with metallocene or constrained geometry catalysts have a potential negative impact on the electrical dissipation properties of the polymer. These ionic residues can migrate into the insulation layer of the cable under aging conditions and influence the dielectric losses of the cable. The results reported in Table 4 suggest that these ionic species have not migrated into the insulation layer to an extent as to have a negative impact on the dielectric losses of the cable.

We claim:

1. A process of degassing a power cable, the cable comprising:

(A) a conductor, (B) an insulation layer, and (C) a semiconductor layer comprising in weight percent based on the weight of the semiconductor layer:

(1) 49-98% of a crosslinked olefin block copolymer (OBC) having a density less than (<) 0.9 grams per cubic centimeter (g/cm$^3$), a melt index greater than (>) 1, and comprising in weight percent based on the weight of the OBC:

(a) 35-80% soft segment that comprises 5-50 mole percent (mol %) of units derived from a monomer comprising 3 to 30 carbon atoms; and (b) 20-65% hard segment that comprises 0.2-3.5 mol % of units derived from a monomer comprising 3 to 30 carbon atoms;

(2) 2-51% conductive filler;

the insulation layer and semiconductor layer in contact with one another, the process comprising the step of exposing the cable to a temperature of at least 80° C. for a period of time of at least 24 hours.

2. The process of claim 1 in which the cable is exposed to a temperature of at least 100° C.

3. The process of claim 1 in which the conductive filler is carbon black.

4. The process of claim 3 in which the carbon black has an arithmetic mean particle size of greater than 29 nanometers.

5. The process of claim 1 in which the insulation layer comprises a polyolefin.

6. The process of claim 5 in which the polyolefin is a copolymer of ethylene and an unsaturated ester.

7. The process of claim 1 in which the OBC is an ethylene multi-block interpolymer.

8. The process of claim 1 in which the crosslinked OBC exhibits a thermo-mechanical analysis of 0.1 mm probe penetration at a temperature greater than 85° C.

9. The process of claim 8 in which the crosslinked OBC exhibits a gel content of greater than 30%.

10. The process of claim 9 in which the crosslinked OBC exhibits a volume resistivity of less than 50,000 ohm-cm at 23° C., 90° C. and 130° C.

* * * * *